US010875299B2

(12) United States Patent
Ozawa

(10) Patent No.: US 10,875,299 B2
(45) Date of Patent: Dec. 29, 2020

(54) LIQUID DROPLET EJECTING APPARATUS AND LIQUID DROPLET EJECTING HEAD

(71) Applicant: SEIKO EPSON CORPORATION, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/728,882

(22) Filed: Dec. 27, 2019

(65) Prior Publication Data

US 2020/0207083 A1 Jul. 2, 2020

(30) Foreign Application Priority Data

Dec. 28, 2018 (JP) ..... 2018-247042

(51) Int. Cl.
*B41J 2/045* (2006.01)
*B41J 2/14* (2006.01)

(52) U.S. Cl.
CPC ..... *B41J 2/04581* (2013.01); *B41J 2/0451* (2013.01); *B41J 2/04541* (2013.01);
(Continued)

(58) Field of Classification Search
CPC ..... B41J 2/04581; B41J 2/04588; B41J 2/14032; B41J 2/04541; B41J 2/04573;
(Continued)

(56) References Cited

U.S. PATENT DOCUMENTS 6,481,833 B1 * 11/2002 Fujii ..... B41J 2/04525 347/68
8,864,262 B2 * 10/2014 Kobayashi ..... B41J 2/04553 347/10

(Continued)

FOREIGN PATENT DOCUMENTS

JP 2004-284189 10/2004
JP 2016-000527 1/2016
JP 6079835 2/2017

*Primary Examiner* — Huan H Tran
*Assistant Examiner* — Alexander D Shenderov
(74) *Attorney, Agent, or Firm* — Workman Nydegger

(57) ABSTRACT

A liquid droplet ejecting apparatus includes a nozzle; a flow-path-section having a first pressure-chamber, a communication-path enabling the nozzle to communicate with the first pressure-chamber, and a second pressure-chamber communicating with the first pressure-chamber through the communication-path; a first signal-generator that generates a first driving signal to drive a first piezoelectric-element; a second signal-generator that generates a second driving signal to drive a second piezoelectric-element; and an inspector that inspects ejection from the nozzle based on electromotive force generated by the first piezoelectric-element due to residual vibration that has occurred in the flow-path-section due to the driving of the first piezoelectric-element. The first driving signal includes a first inspection waveform. The second driving signal includes a second inspection waveform having a polarity opposite to the first inspection waveform for a time period overlapping a first formation time period for the first inspection waveform.

7 Claims, 11 Drawing Sheets

(52) U.S. Cl.
CPC ..... *B41J 2/04573* (2013.01); *B41J 2/04588* (2013.01); *B41J 2/14032* (2013.01)

(58) Field of Classification Search
CPC ..... B41J 2/0451; B41J 2002/14241; B41J 2002/14491; B41J 2202/12; B41J 2/14233
USPC ..... 347/9–11, 68–70
See application file for complete search history.

(56) References Cited

U.S. PATENT DOCUMENTS

| | | | | |
|---|---|---|---|---|
| 2006/0221144 | A1* | 10/2006 | Nagashima | B41J 2/14233 347/70 |
| 2010/0214334 | A1* | 8/2010 | Kusunoki | B41J 29/38 347/9 |
| 2012/0249638 | A1* | 10/2012 | Takano | B41J 2/0454 347/10 |
| 2016/0167364 | A1* | 6/2016 | Matsumoto | B41J 2/04588 347/9 |
| 2018/0201019 | A1* | 7/2018 | Seto | B41J 2/18 |
| 2019/0299619 | A1* | 10/2019 | Katayama | B41J 2/175 |
| 2020/0223227 | A1* | 7/2020 | Sugiura | B41J 2/14233 |

* cited by examiner

LIQUID DROPLET EJECTING APPARATUS AND LIQUID DROPLET EJECTING HEAD

The present application is based on, and claims priority from JP Application Serial Number 2018-247042, filed on Dec. 28, 2018, the disclosure of which is hereby incorporated by reference herein in its entirety.

BACKGROUND

1. Technical Field

The present disclosure relates to a liquid droplet ejecting apparatus.

2. Related Art

An ink jet printer, which includes a liquid droplet ejecting head having multiple nozzles for ejecting ink, is known. An ink jet printer described in JP-A-2004-284189 includes a liquid droplet ejecting head ejecting ink from a nozzle communicating with the inside of a cavity filled with ink. An actuator is driven to change pressure within the cavity to cause the liquid droplet ejecting head to eject the ink from the nozzle.

In the ink jet printer, the nozzle may be clogged by increasing of viscosity of ink, air bubbles mixed in the nozzle, adhesion of paper dust, and the like, and an ejection abnormality may occur in the liquid droplet ejecting head. JP-A-2004-284189 discloses a head abnormality detecting unit for detecting an ejection abnormality. The head abnormality detecting unit drives an actuator to the extent that ink is not ejected. Then, the head abnormality detecting unit detects an ejection abnormality of a liquid droplet ejecting head based on residual vibration of a cavity.

It is necessary that, in the head abnormality detecting unit described in JP-A-2004-284189, the displacement of the actuator when the actuator is driven to the extent that ink is not ejected be smaller than the displacement of the actuator when the actuator is driven for ink ejection. Thus, when the head abnormality detecting unit is applied to a circulation liquid droplet ejecting head having a nozzle in the middle of an ink circulation flow path, the residual vibration is significantly attenuated due to a long distance between the nozzle and a pressure chamber. There is, therefore, a problem that even when the head abnormality detecting unit of the related art is applied to the circulation liquid droplet ejecting head, it is difficult to detect an ejection abnormality with high accuracy.

SUMMARY

According to an aspect of the disclosure, a liquid droplet ejecting apparatus includes a nozzle that ejects a liquid; a flow path section having a first pressure chamber, a communication path enabling the nozzle to communicate with the first pressure chamber, and a second pressure chamber communicating with the first pressure chamber through the communication path; a first piezoelectric element that changes pressure within the first pressure chamber; a second piezoelectric element that changes pressure within the second pressure chamber; a first signal generator that generates a first driving signal to drive the first piezoelectric element; a second signal generator that generates a second driving signal to drive the second piezoelectric element; and an inspector that inspects the ejection from the nozzle based on electromotive force generated by the first piezoelectric element due to residual vibration that has occurred in the flow path section due to the driving of the first piezoelectric element. The first driving signal includes a first inspection waveform. The second driving signal includes a second inspection waveform having a polarity opposite to the first inspection waveform for a time period overlapping a first time period for the first inspection waveform.

According to another aspect of the disclosure, a liquid droplet ejecting apparatus includes a nozzle that ejects a liquid; a flow path section having a first pressure chamber, a communication path enabling the nozzle to communicate with the first pressure chamber, and a second pressure chamber communicating with the first pressure chamber through the communication path; a first piezoelectric element that changes pressure within the first pressure chamber; a second piezoelectric element that changes pressure within the second pressure chamber; a first signal generator that generates a first driving signal to drive the first piezoelectric element; a second signal generator that generates a second driving signal to drive the second piezoelectric element; and an inspector that inspects the ejection from the nozzle based on electromotive force generated by the first piezoelectric element due to residual vibration that has occurred in the flow path section due to the driving of the first piezoelectric element. The second driving signal includes a second inspection waveform. The first driving signal includes a first inspection waveform having a polarity identical with the second inspection waveform in a time period of ½ of a specific cycle of the second piezoelectric element. The time period is from an end of a second formation time period for the second inspection waveform.

DESCRIPTION OF EXEMPLARY EMBODIMENTS

Figure 1:
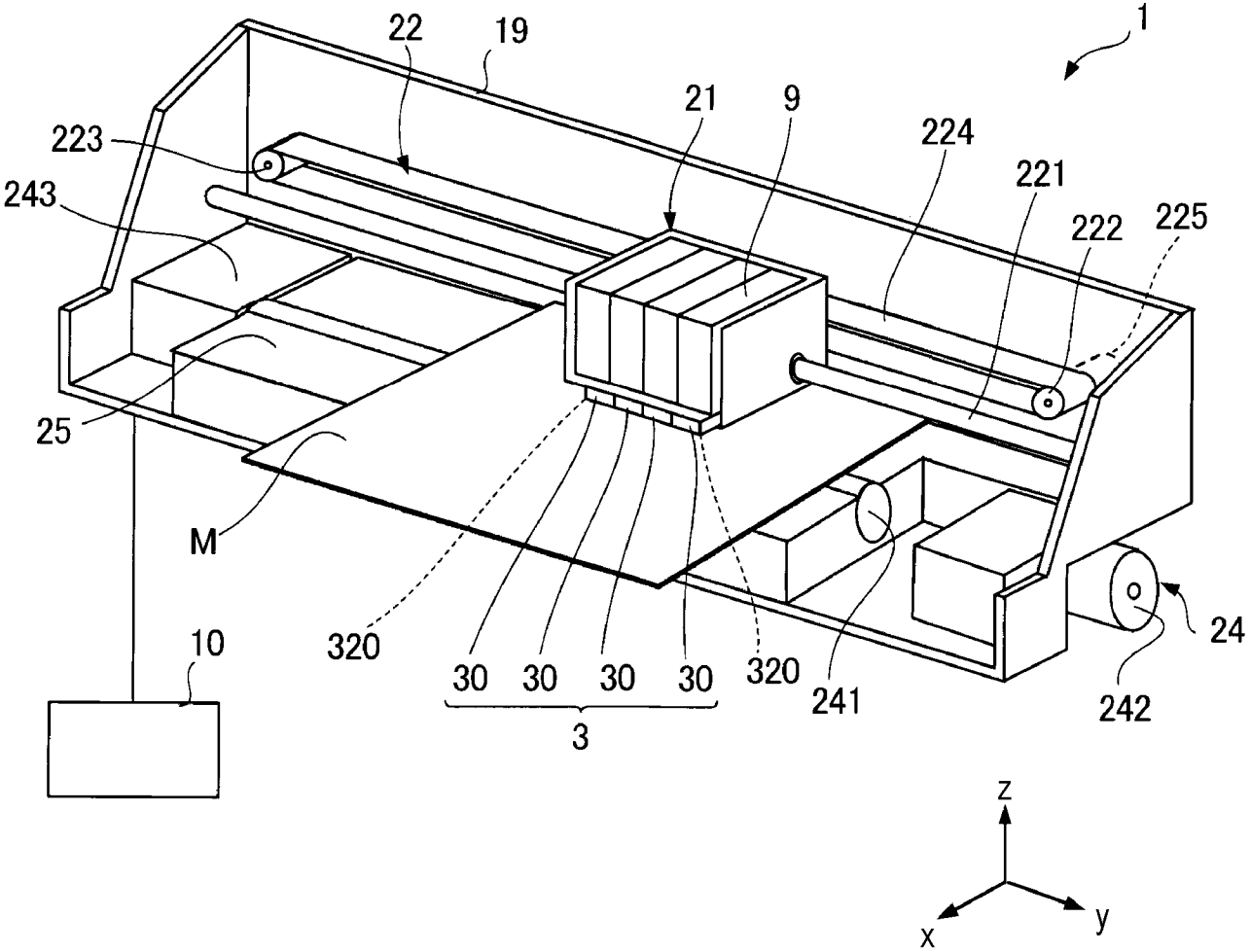
FIG. 1 is a perspective view depicting an internal structure of a printer according to a first embodiment.

Embodiments of the disclosure are described with reference to the accompanying drawings. In the drawings, dimensions and scales of components may be different from those of the actual components, and some of the components are schematically depicted to easily understand the components. The scope of the disclosure is not limited to the embodiments, unless otherwise stated in the following description that a limitation is imposed on the disclosure.

1. First Embodiment

1-1. Entire Configuration of Printer 1

FIG. 1 is a perspective view depicting an internal structure of a printer 1 according to a first embodiment. The following description uses x, y, and z axes perpendicular to each other and depicted in FIG. 1 in some cases. In the following description, a direction toward which a z axis arrow points is referred to as +z direction and indicates an "upper side" or a "+z axis side", while a direction opposite to the direction toward which the z axis arrow points is referred to as −z direction and indicates a "lower side" or a "−z axis side".

The printer 1 depicted in FIG. 1 is an example of a "liquid droplet ejecting apparatus" and is an ink jet printer that ejects a liquid such as ink onto a medium M such as paper and forms an image on the medium M. The image may be an image of only character information.

The printer 1 includes a carriage 21, a moving mechanism 22, a print head 3, a transport mechanism 24, and a control unit 10. The print head 3 is an example of a "liquid droplet ejecting head".

The carriage 21 is a cartridge holder for holding multiple cartridges 9 for storing ink. The carriage 21 is movable by the moving mechanism 22. In FIG. 1, the carriage 21 holds four cartridges 9 corresponding to four colors, which are, for example, yellow, cyan, magenta, and black.

The moving mechanism 22 causes the carriage 21 to reciprocate in a y direction or move toward a +y direction and a −y direction. The moving mechanism 22 includes a guide shaft 221, a first pulley 222, a second pulley 223, a timing belt 224, and a carriage motor 225. The guide shaft 221 extends in the y direction. Both ends of the guide shaft 221 are fixed to a support member 19 installed in a casing of the printer 1. The timing belt 224 is stretched over the first pulley 222 and the second pulley 223. The timing belt 224 extends parallel to or nearly parallel to the guide shaft 221. The first pully 222 is rotationally driven by the carriage motor 225 serving as a driving source.

The carriage 21 is supported by the guide shaft 221 so that the carriage 21 can reciprocate. The carriage 21 is fixed to a portion of the timing belt 224. Thus, when the carriage motor 225 causes the timing belt 224 to travel forward and backward, the carriage 21 is guided by the guide shaft 221 to reciprocate.

The print head 3 is installed under the carriage 21. The print head 3 is coupled to the carriage 21 and moves with the carriage 21. The print head 3 ejects ink onto the medium M located under the print head 3. The print head 3 includes four head units 30 for the four colors. Each of the head units 30 has multiple nozzles 320 for ejecting ink.

The medium M is transported by the transport mechanism 24. The transport mechanism 24 transports the medium M under control by the control unit 10. The transport mechanism 24 includes a transport roller 241 and a transport motor 242. The transport roller 241 is rotationally driven by the transport motor 242 serving as a driving source. A platen 25 is installed under the carriage 21.

The medium M is transported by the transport roller 241 to pass through a gap between the carriage 21 and the platen 25 toward a +x direction. In this case, ink is ejected by the print head 3 onto the medium M.

The control unit 10 includes a control device such as a central processing unit (CPU) or a field-programmable gate array (FPGA) and a storage device such as a semiconductor memory. The control unit 10 causes the control device to execute various programs stored in the storage device, thereby comprehensively controlling the components included in the printer 1. The printer 1 transports the medium M and ejects ink onto the medium M to form an image on the medium M under the control by the control unit 10.

1-2. Control Unit 10

Figure 2:
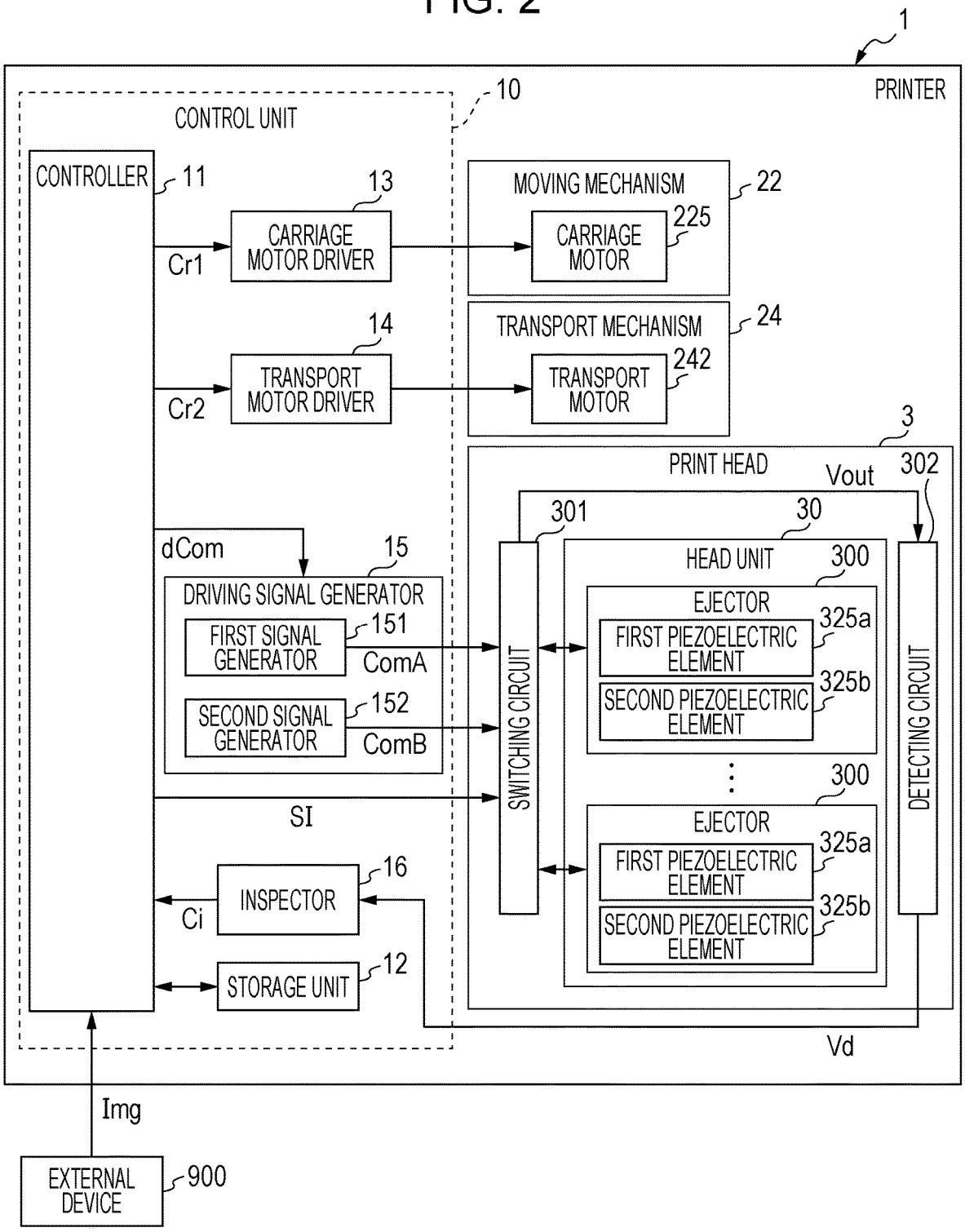
FIG. 2 is a block diagram depicting a configuration of the printer according to the first embodiment.

Next, the control unit 10 is described with reference to FIG. 2. FIG. 2 is a block diagram depicting a configuration of the printer 1 according to the first embodiment.

As depicted in FIG. 2, the control unit 10 includes a controller 11, a storage unit 12, a carriage motor driver 13, a transport motor driver 14, a driving signal generator 15, and an inspector 16. The aforementioned control device such as the CPU functions as the controller 11, the driving signal generator 15, and the inspector 16. The aforementioned storage device such as the semiconductor memory functions as the storage unit 12.

The controller 11 controls operations of the components included in the printer 1. Print data Img is supplied from an external device 900 to the controller 11. The external device 900 is a host computer or the like. The print data Img is data indicating an image to be formed by the printer 1. The controller 11 generates and outputs, based on the print data Img, various signals to control operations of the components included in the printer 1. Examples of the various signals are a carriage control signal Cr1, a transport control signal Cr2, a waveform specifying signal dCom, and a print signal SI.

The carriage control signal Cr1 is a signal to control an operation of the carriage motor driver 13. The carriage motor driver 13 drives the carriage motor 225. The transport control signal Cr2 is a signal to control an operation of the transport motor driver 14. The transport motor driver 14 drives the transport motor 242. The waveform specifying signal dCom is a digital voltage signal defining waveforms of first and second driving signals ComA and ComB to drive the print head 3. The print signal SI is a digital voltage signal specifying whether the first driving signal ComA and the second driving signal ComB are to be supplied. The controller 11 acquires or generates various control signals excluding the print signal SI and including a clock signal and a latch signal.

The driving signal generator 15 includes a digital-to-analog (DA) conversion circuit. The driving signal generator 15 includes a first signal generator 151 and a second signal generator 152. The first signal generator 151 generates the first driving signal ComA based on the waveform specifying signal dCom. The second signal generator 152 generates the second driving signal ComB based on the waveform specifying signal dCom. The first driving signal ComA and the second driving signal ComB are analog voltage signals to drive the print head 3. The first driving signal ComA and the second driving signal ComB are described later.

The inspector 16 inspects the ink ejection. The inspector 16 identifies whether an ejection abnormality such as thickening of ink, mixing of air bubbles, or adhesion of paper dust occurred. In addition, the inspector 16 identifies the cause of the ejection abnormality.

The inspector 16 includes a comparator, for example. The inspector 16 compares a residual vibration signal Vd output from the print head 3 with a signal serving as a standard and indicating residual vibration in a normal state and outputs, as an inspection result, a comparison signal Ci indicating a result of the comparison. The residual vibration signal Vd is a signal indicating residual vibration (described later) of the print head 3. For example, the inspector 16 compares a cycle, amplitude, or the like of a waveform of the residual vibration signal Vd with a cycle, amplitude, or the like of a waveform of the signal indicating the residual vibration in the normal state and outputs a result of the comparison as the comparison signal Ci. When an ejection abnormality exists, the controller 11 executes flushing such as test ejection based on the comparison signal Ci.

1-3. Print Head 3

Next, the print head 3 is described. As depicted in FIG. 2, the print head 3 includes the head units 30, a switching circuit 301, and a detecting circuit 302.

Each of the head units 30 includes multiple ejectors 300 for ejecting ink. The ejectors 300 include the nozzles 320 described above. Each of the ejectors 300 includes a first piezoelectric element 325*a* and a second piezoelectric element 325*b*. Ink is ejected from the nozzle 320 of each of the ejectors 300 by driving of either one or both of the first and second piezoelectric elements 325*a* and 325*b* of each of the ejectors 300. The first piezoelectric elements 325*a* are driven by the first driving signal ComA. The second piezoelectric elements 325*b* are driven by the second driving signal ComB.

The switching circuit 301 switches, based on the print signal SI or the like, whether the first driving signal ComA is supplied from the switching circuit 301 to the first piezoelectric elements 325*a*. The switching circuit 301 switches, based on the print signal SI, whether the second driving signal ComB is supplied from the switching circuit 301 to the second piezoelectric elements 325*b*. The switching circuit 301 switches, based on the print signal SI, whether detection potential signals Vout are supplied from the switching circuit 301 to the detecting circuit 302. The detection potential signals Vout are generated by the first piezoelectric elements 325*a* due to residual vibration described later.

The detecting circuit 302 generates the residual vibration signal Vd based on the detection potential signals Vout generated by the first piezoelectric elements 325*a*. The residual vibration signal Vd is obtained by removing noise from the detection potential signals Vout and amplifying the detection potential signals Vout.

1-3a. Configuration of Each Head Unit 30

Figure 3:
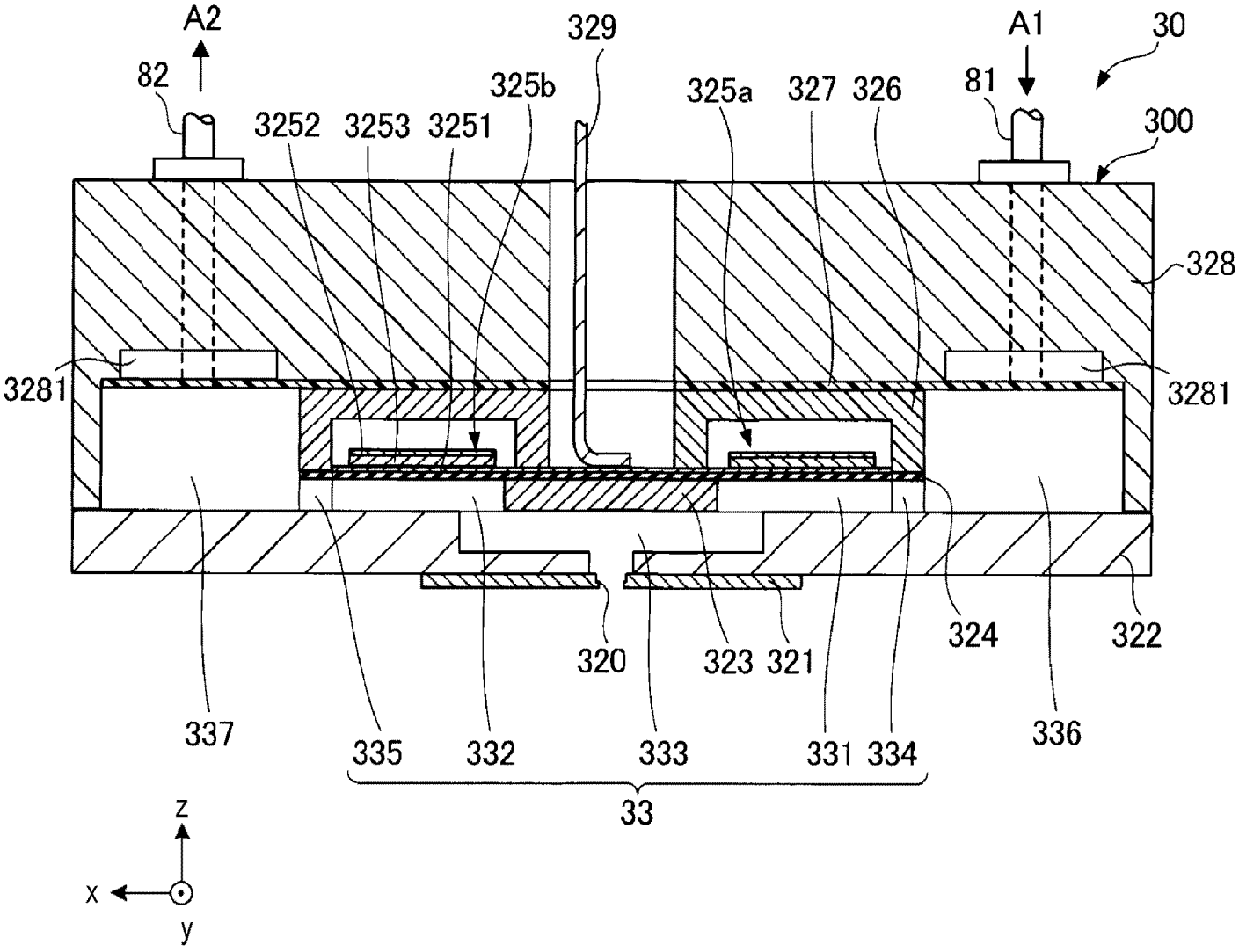
FIG. 3 is a sectional view depicting a configuration of each of head units according to the first embodiment.

Next, a configuration of each of the head units 30 is described with reference to FIG. 3. FIG. 3 is a sectional view depicting the configuration of each of the head units 30 according to the first embodiment. Although not depicted in FIG. 3, multiple ejectors 300 included in each of the head units 30 are arranged side by side in the y direction. FIG. 3 depicts a single ejector 300.

As depicted in FIG. 3, the head unit 30 is coupled to a supply tube 81 and an outflow tube 82. Although not depicted in FIG. 3, the supply tube 81 and the outflow tube 82 are coupled to an ink tank for storing ink supplied from the cartridges 9. The ink stored in the ink tank is supplied from the supply tube 81 to the head unit 30 as indicated by an arrow A1 and flows to the outflow tube 82 through the head unit 30 as indicated by an arrow A2. Specifically, the head unit 30 includes circulation flow paths for circulating ink. Thus, the head unit 30 having the circulation flow paths can suppress thickening of ink within the head unit 30, compared with the case where the circulation flow paths do not exist. The configuration of the head unit 30 is described below.

The head unit 30 includes a nozzle plate 321, a communication plate 322, a flow path substrate 323, a vibration plate 324, first piezoelectric elements 325*a*, second piezoelectric elements 325*b*, a protective substrate 326, and a compliance substrate 327, and a case 328. The head unit 30 also includes flow path sections 33, a first manifold 336, and a second manifold 337, while each of the flow path sections 33 forms a portion of each of the circulation flow paths. A first piezoelectric element 325*a*, a second piezoelectric element 325*b*, and a flow path section 33 are provided for each of the ejectors 300. The other components are common to the multiple ejectors 300.

The nozzle plate 321 is long and extends in the y direction and has multiple nozzles 320 for ejecting a liquid such as ink. The multiple nozzles 320 are arranged side by side in the y direction. Each of the nozzles 320 is provided for a respective one of the ejectors 300. The nozzles 320 are through-holes formed in the nozzle plate 321.

The communication plate 322 is mounted on a surface of the nozzle plate 321 on the +z axis side with respect to the nozzle plate 321. Through-holes, which overlap the nozzles 320 in a plan view, are formed in the communication plate 322. The through-holes form communication paths 333 described later. Examples of a constituent material of the nozzle plate 321 and examples of a constituent material of the communication plate 322 are silicon, glass, ceramics, metal, and resin.

The flow path substrate 323 is mounted on a surface of the communication plate 322 on the +z axis side with respect to the communication plate 322. The flow path substrate 323 is a silicon monocrystalline substrate, which is long and extends in the y direction. A constituent material of the flow path substrate 323 may be glass, metal, or the like. The flow path substrate 323 has multiple through-holes opening in the z direction. Each of the through-holes forms a first pressure chamber 331, a second pressure chamber 332, a supply path 334, and an outflow path 335, which are described later. The flow path substrate 323 and the communication plate 322 form the flow path sections 33.

Each of the flow path sections 33 includes a first pressure chamber 331, a second pressure chamber 332, a communication path 333, a supply path 334, and an outflow path 335. The first pressure chamber 331 and the second pressure chamber 332 communicate with each other through the communication path 333. The supply path 334 communicates with the first pressure chamber 331 and has a smaller width than that of the first pressure chamber 331. The outflow path 335 communicates with the second pressure chamber 332 and has a smaller width than that of the second pressure chamber 332. Each of the flow path sections 33 is formed for a respective one of the nozzles 320. The multiple flow path sections 33 are arranged side by side in the y direction, like the nozzles 320. The nozzles 320 exist between the first pressure chambers 331 and the second pressure chambers 332 when viewed from the +z direction.

The vibration plate 324 is mounted on a surface of the flow path substrate 323 on the +z axis side with respect to the flow path substrate 323. The vibration plate 324 includes a laminated layer of an elastic film including a silicon dioxide and an insulating film including a zirconium oxide.

The first piezoelectric elements 325*a* and the second piezoelectric elements 325*b* are mounted on a surface of the vibration plate 324 on the +z axis side with respect to the vibration plate 324. In the first embodiment, the first piezoelectric elements 325*a* and the second piezoelectric elements 325*b* have substantially the same configuration, except that the arrangement of the first piezoelectric elements 325*a* is different from the arrangement of the second piezoelectric elements 325*b*.

The first piezoelectric element 325*a* overlaps the first pressure chamber 331 in the z direction and changes pressure within the first pressure chamber 331, and the second piezoelectric element 325*b* overlaps the second pressure chamber 332 in the z direction and changes pressure within the second pressure chamber 332. Each of the first and second piezoelectric elements 325*a* and 325*b* includes a first electrode 3251, a second electrode 3252, and a piezoelectric body layer 3253 between the first and second electrodes 3251 and 3252. The first electrode 3251 is a common electrode mounted on the vibration plate 324. The second electrode 3252 is an individual electrode. The first electrode 3251 may be the individual electrode, while the second electrode 3252 may be the common electrode.

The first electrodes 3251 and the second electrodes 3252 are individually coupled to a wiring substrate 329 composed of a flexible wiring and the like. The second electrodes 3252 are coupled to the wiring substrate 329 via lead terminals (not depicted). The wiring substrate 329 is electrically coupled to the switching circuit 301 and the detecting circuit 302. Each of the first and second electrodes 3251 and 3252 is composed of a laminated body of titanium and iridium or the like.

The protective substrate 326 is mounted on the surface of the vibration plate 324 on the +z axis side with respect to the vibration plate 324. The protective substrate 326 is a plate-shape member formed in a rectangular shape in a planar view. The protective substrate 326 includes recesses configured to store the first piezoelectric elements 325*a* and opening on the +z axis side, recesses configured to store the second piezoelectric elements 325*b* and opening on the +z axis side, and a through-hole through which the wiring substrate 329 extends. Examples of a constituent material of the protective substrate 326 are glass, ceramics, metal, and resin.

The compliance substrate 327 is mounted on a surface of the protective substrate 326 on the +z axis side with respect to the protective substrate 326. The compliance substrate 327 includes a flexible film including resin. The compliance substrate 327 limits a variation in pressure of ink within the first and second pressure chambers 331 and 332. The compliance substrate 327 includes a through-hole through which the wiring substrate 329 extends.

The case 328 is mounted on a surface of the compliance substrate 327 on the +z axis side with respect to the compliance substrate 327. The case 328 is joined to the communication plate 322 so that the case 328 stores the components located between the compliance substrate 327 and the communication plate 322. Two spaces 3281 that allow the displacement of the compliance substrate 327 are formed between the case 328 and the compliance substrate 327.

The case 328, the compliance substrate 327, and the communication plate 322 form the first manifold 336 and the second manifold 337. The first manifold 336 and the second manifold 337 communicate with all the flow path sections 33 included in the ejectors 300. The first manifold 336 communicates with the supply paths 334. The second manifold 337 communicates with the outflow paths 335. The first manifold 336 causes ink supplied from the supply tube 81 to separately flow into the flow path sections 33. The second manifold 337 collects the ink from the flow path sections 33 and causes the ink to flow out of the outflow tube 82.

In each of the above-configured ejectors 300, the pressure of ink within the flow path section 33 is changed by the vibration, caused by the driving of either one or both of the first and second piezoelectric elements 325*a* and 325*b*, of the vibration plate 324. In the first embodiment, the ink is ejected from the nozzle 320 when the vibration plate 324 is deformed toward the +z axis side by the driving of both the first and second piezoelectric elements 325*a* and 325*b*.

In each of the above-configured ejectors 300, ink circulates through the supply tube 81, the first manifold 336, the flow path section 33, the second manifold 337, and the outflow tube 82 in this order. For example, the ink can be circulated by shifting the timing of driving the first piezoelectric element 325*a* from the timing of driving the second piezoelectric element 325*b* by a predetermined time period. For example, a liquid circulating unit such as a pump may be installed in the middle of the outflow path 82 and the ink may be circulated within the flow path section 33.

In the first embodiment, each of the ejectors 300 is symmetric about a virtual plane parallel to a Y-Z plane. It is preferable that M1<M3<M2 in each of the flow path sections 33 included in the ejectors 300, where M1 is an inertance of the nozzle 320, M3 is an inertance of the outflow path 335, and M2 is an inertance of the supply path 334. The inertances M1, M2, and M3 indicate the ease of the flow of a fluid. The inertances M1, M2, and M3 can be calculated from densities of the ink and lengths, widths, and heights of the flow paths. The ink can be easily circulated by configuring the nozzle 320, the supply path 334, and the outflow path 335 so that M1<M3<M2.

1-3b. Configuration of Switching Circuit 301

Figure 4:
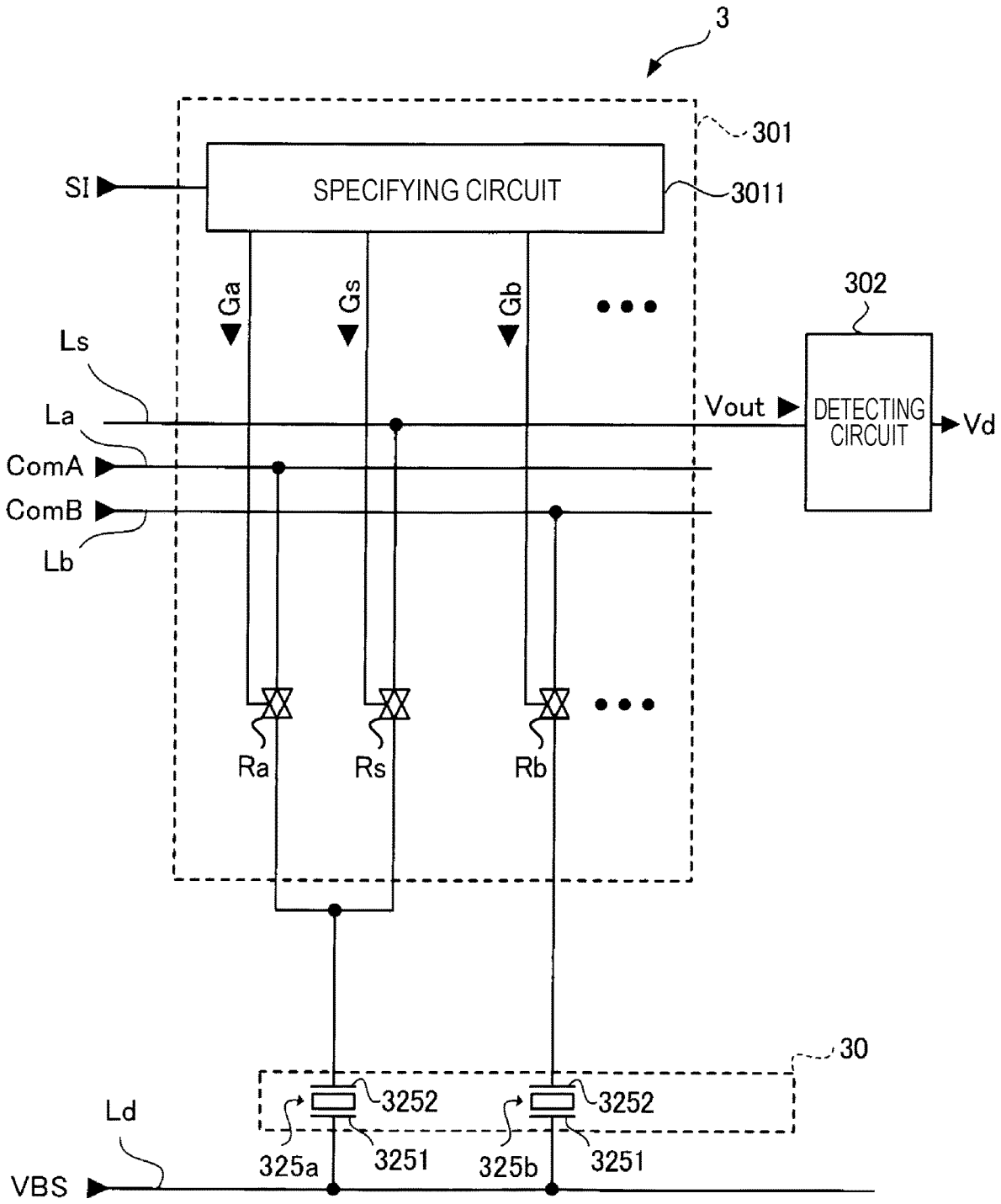
FIG. 4 is a block diagram depicting a configuration of a print head according to the first embodiment.

Next, a configuration of the switching circuit 301 is described with reference to FIG. 4. FIG. 4 is a block diagram depicting a configuration of the print head 3 according to the first embodiment. FIG. 4 focuses on a portion corresponding to a single ejector 300.

The switching circuit 301 includes a specifying circuit 3011 and multiple switches Ra, Rb, and Rs. The print head 3 has wirings La, Lb, and Ls and a feeder Ld. The first driving signal ComA is supplied from the first signal generator 151 through the wiring La. The second driving signal ComB is supplied from the second signal generator 152 through the wiring Lb. A detection potential signal Vout is supplied from the first piezoelectric element 325*a* to the detecting circuit 302 through the wiring Ls. A bias potential VBS is supplied through the feeder Ld.

The specifying circuit 3011 outputs a specifying signal Ga specifying turning on or off of the switch Ra, a specifying signal Gb specifying turning on or off of the switch Rb, and a specifying signal Gs specifying turning on or off of the switch Rs, based on various control signals including the print signal SI. The specifying circuit 3011 individually controls the turning on and off of the switches Ra, Rb, and Rs. The specifying circuit 3011 outputs the specifying signals Ga, Gb, and Gs to the multiple ejectors 300 in parallel.

The switch Ra switches between conduction and non-conduction between the wiring La and the second electrode 3252 of the first piezoelectric element 325*a* based on the specifying signal Ga. The switch Rs switches between conduction and non-conduction between the wiring Ls and the second electrode 3252 of the first piezoelectric element 325*a* based on the specifying signal Gs. When the specifying circuit 3011 turns on the switch Ra, the specifying circuit 3011 turns off the switch Rs. When the specifying circuit 3011 turns on the switch Rs, the specifying circuit 3011 turns off the switch Ra. The switch Rb switches between conduction and non-conduction between the wiring Lb and the second electrode 3252 of the second piezoelectric element 325*b* based on the specifying signal Gb. The feeder Ld is coupled to the first electrodes 3251 of the first and second piezoelectric elements 325*a* and 325*b*.

1-4. First Driving Signal ComA and Second Driving Signal ComB

Figure 5:
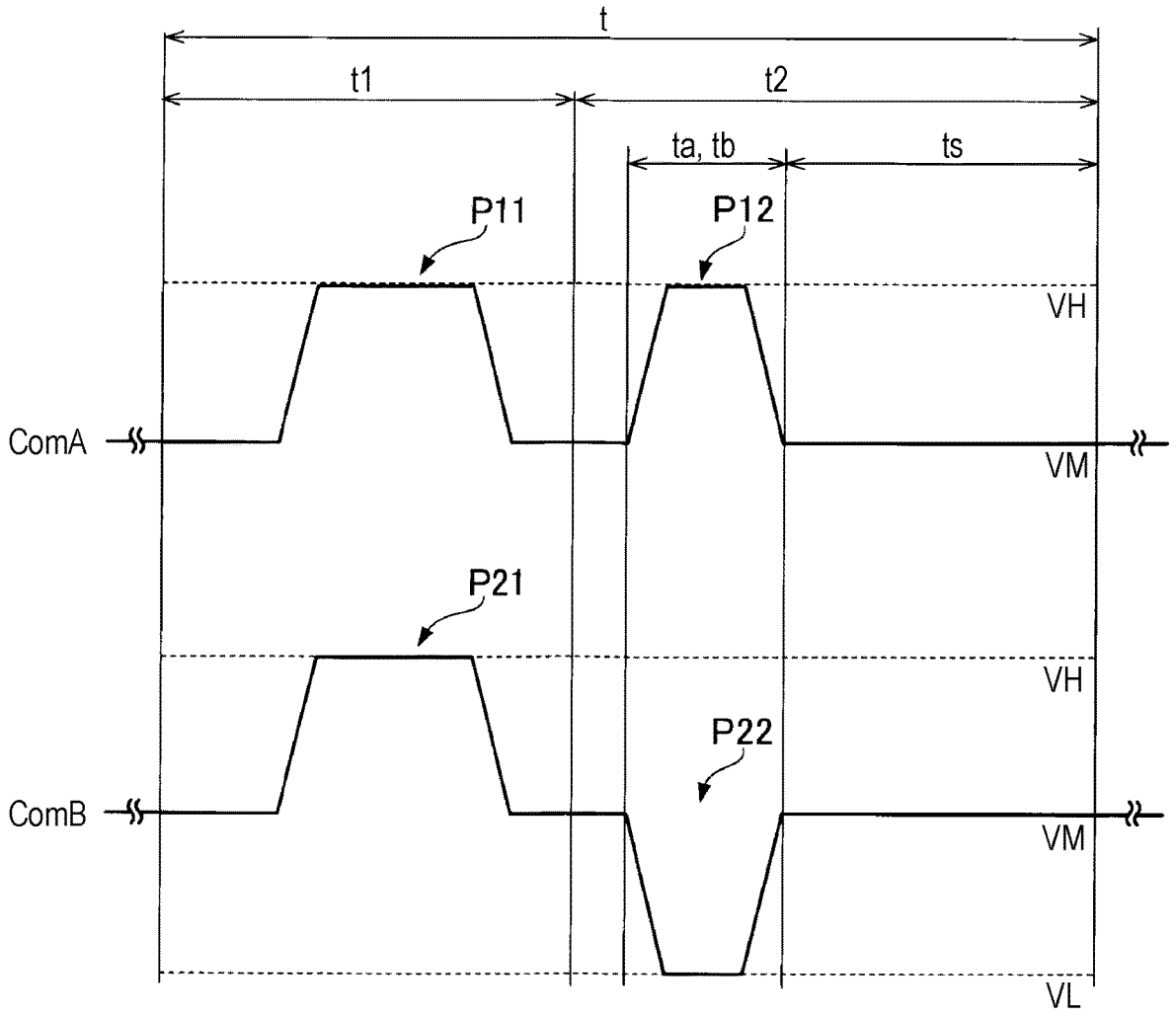
FIG. 5 is a diagram depicting driving waveforms of first and second driving signals according to the first embodiment.

Next, the first driving signal ComA and the second driving signal ComB are described with reference to FIG. 5. FIG. 5 is a diagram depicting driving waveforms of the first and second driving signals ComA and ComB according to the first embodiment. FIG. 5 depicts the driving waveforms for a single cycle t. The driving waveforms depicted in FIG. 5 are repeated for each of cycles t. Each of the cycles t includes a first time period t1 and a second time period t2. The first time period t1 is a time period for the ink ejection. The second time period t2 is a time period for the inspection of the ink ejection.

The driving waveform of the first driving signal ComA changes in a range from a standard potential VM to a high potential VH higher than the standard potential VM. The driving waveform of the first driving signal ComA includes a first ejection waveform P11 and a first inspection waveform P12 succeeding the first ejection waveform P11. The first ejection waveform P11 is formed within the first time period t1. The first inspection waveform P12 is formed within the second time period t2. A time period that is included in the second time period t2 and for which the first inspection waveform P12 is formed is a first formation time period ta.

The first ejection waveform P11 is a positive waveform with a potential higher than the standard potential VM. Specifically, the first ejection waveform P11 rises from the standard potential VM to the high potential VH. Then, the first ejection waveform P11 is maintained at the high potential VH for a predetermined time period and falls from the high potential VH to the standard potential VM. The first inspection waveform P12 is a positive waveform with a potential higher than the standard potential VM. Specifically, the first inspection waveform P12 rises from the standard potential VM to the high potential VH. Then, the first inspection waveform P12 is maintained at the high potential VH for a predetermined time period and falls from the high potential VH to the standard potential VM.

The driving waveform of the second driving signal ComB changes in a range from the high potential VH higher than the standard potential VM to a low potential VL lower than the standard potential VM. The driving waveform of the second driving signal ComB includes a second ejection waveform P21 and a second inspection waveform P22 succeeding the second ejection waveform P21. The second ejection waveform P21 is formed within the first time period t1. The second inspection waveform P22 is formed within the second time period t2. A time period that is included in the second time period t2 and for which the second inspection waveform P22 is formed is a second formation time period tb. In the first embodiment, the second formation time period tb matches the first formation time period ta. Specifically, the second inspection waveform P22 is formed for the time period for which the first inspection waveform P12 is formed.

The second ejection waveform P21 is a positive waveform with a potential higher than the standard potential VM. Specifically, the second ejection waveform P21 rises from the standard potential VM to the high potential VH. Then, the second ejection waveform P21 is maintained at the high potential VH for a predetermined time period and falls from the high potential VH to the standard potential VM. The second inspection waveform P22 is a negative waveform with a potential lower than the standard waveform VM. Specifically, the second inspection waveform P22 falls from the standard potential VM to the low potential VL. Then, the second inspection waveform P22 is maintained at the low potential VL for the predetermined time period and rises from the low potential VL to the standard potential VM. The second inspection waveform P22 has a polarity opposite to the first inspection waveform P12. Since the first driving signal ComA and the second driving signal ComB are repeated for each of the cycles t, the phase of the first inspection waveform P12 is opposite to the phase of the second inspection waveform P22.

The second time period t2 includes the first formation time period ta or the second formation time period tb and an analysis time period ts in which residual vibration, caused by the first inspection waveform P12, of the flow path section 33 is analyzed. The analysis time period ts is after the first formation time period ta. In the analysis time period ts, the detecting circuit 302 detects the detection potential signal Vout generated by the first piezoelectric element 325*a*.

1-5. Driving of Print Head 3 in Ink Ejection

Figure 6:
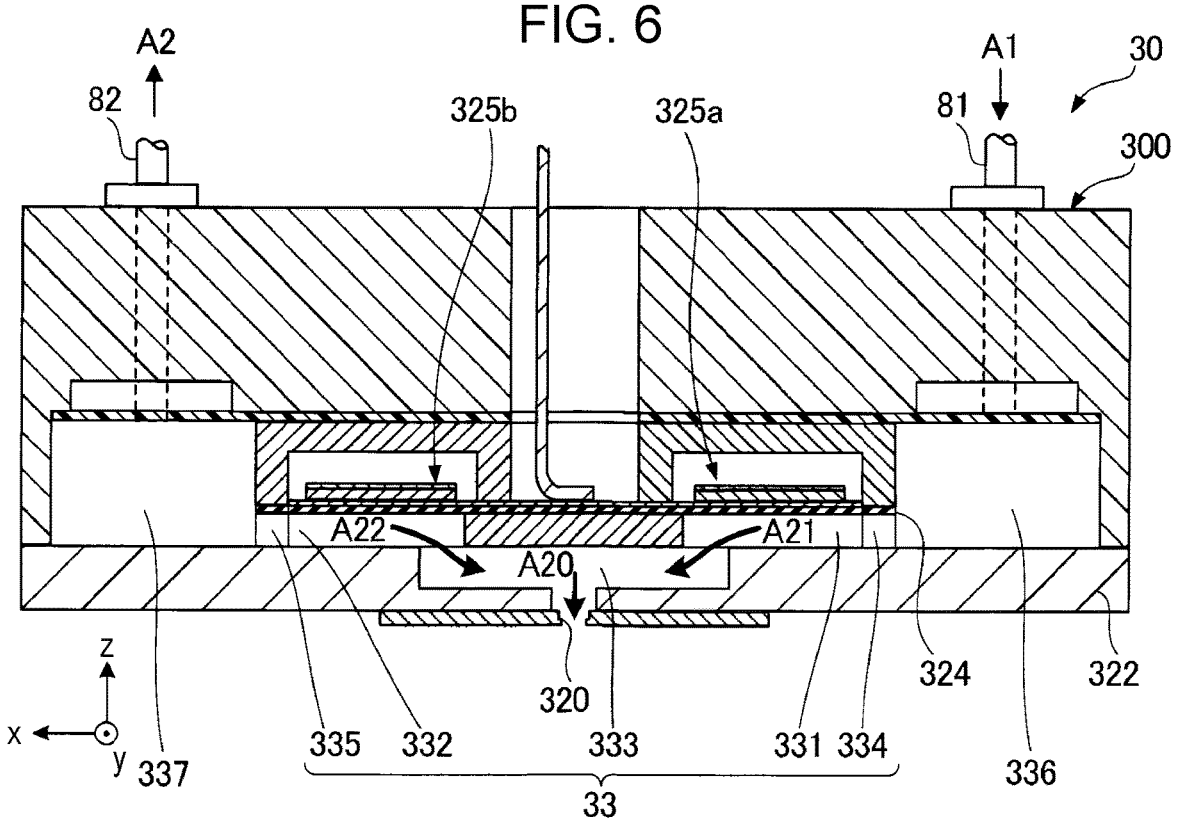
FIG. 6 is a diagram depicting the flow of ink in ink ejection according to the first embodiment.

Next, the driving of the print head 3 in the ink ejection is described with reference to FIGS. 4, 5, and 6. FIG. 6 is a diagram depicting the flow of the ink in the ink ejection according to the first embodiment.

In the ink ejection, the switches Ra and Rb depicted in FIG. 4 are turned on under control by the specifying circuit 3011 based on the print signal SI only in the first time period t1 depicted in FIG. 5. When the switches Ra and Rb are turned on, a signal with the first ejection waveform P11 depicted in FIG. 5 is applied to the first piezoelectric element 325*a*, and a signal with the second ejection waveform P21 depicted in FIG. 5 is applied to the second piezoelectric element 325*b*. Since the high potential VH is applied to the first and second piezoelectric elements 325*a* and 325*b*, the first and second piezoelectric elements 325*a* and 325*b* and portions that are included in the vibration plate 324 and are in contact with the first and second piezoelectric elements 325*a* and 325*b* are deformed toward the −z axis side. Thus, as depicted in FIG. 6, the ink within the first pressure chamber 331 flows toward the communication path 333 as indicated by an arrow A21 and the ink within the second pressure chamber 332 flows toward the communication path 333 as indicated by an arrow A22. Accordingly, the ink within the communication path 333 flows toward the nozzle 320 as indicated by an arrow A20. As a result, the ink is ejected from the nozzle 320.

1-6. Driving of Print Head 3 in Ejection Inspection

Figure 7:
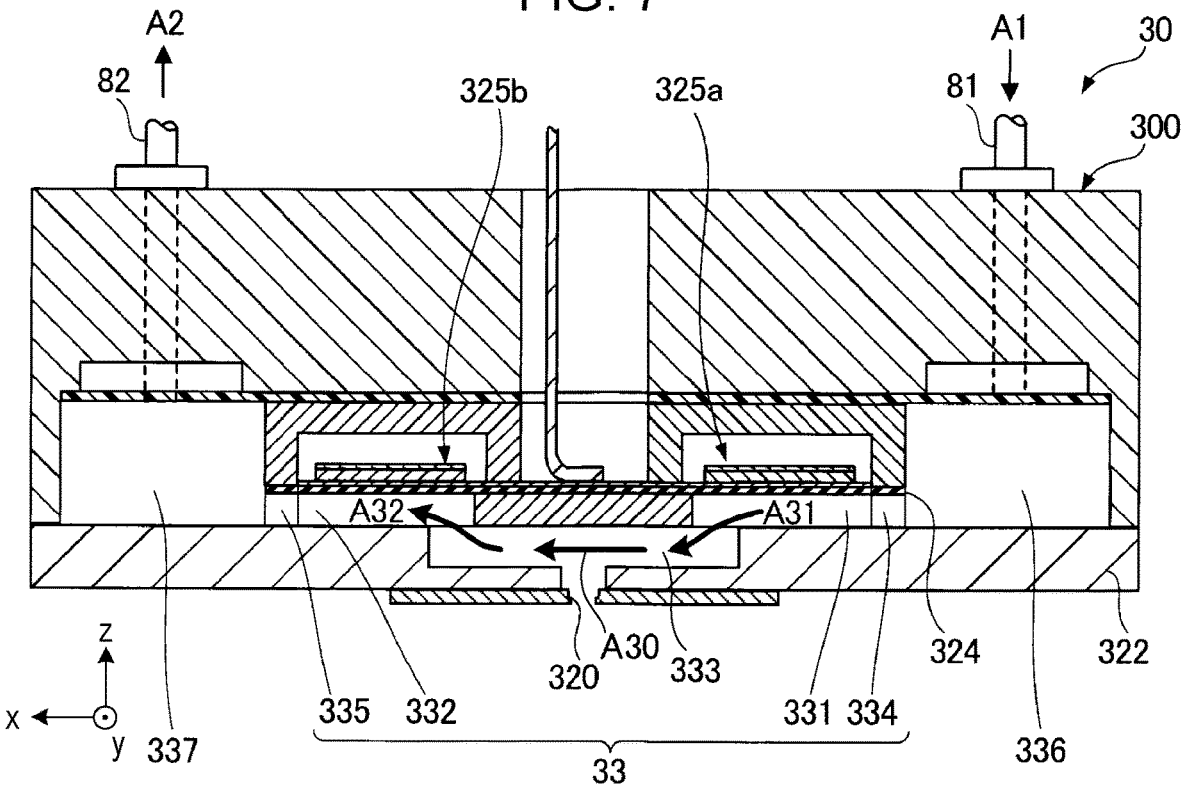
FIG. 7 is a diagram depicting the flow of ink in ejection inspection according to the first embodiment.

Next, the driving of the print head 3 in the ejection inspection is described with reference to FIGS. 4, 5, and 7. FIG. 7 is a diagram depicting the flow of the ink in the ejection inspection according to the first embodiment.

In the ejection inspection, the switches Ra and Rb depicted in FIG. 4 are turned on under control by the specifying circuit 3011 based on the print signal SI only in a time period that is included in the second time period t2 depicted in FIG. 5 and excludes the analysis time period ts. After that, the switches Ra and Rb depicted in FIG. 4 are turned off and the switch Rs depicted in FIG. 4 is turned on under control by the specifying circuit 3011 based on the print signal SI in the analysis time period ts depicted in FIG. 5.

In the time period that is included in the second time period t2 and excludes the analysis time period ts, a signal with the first inspection waveform P12 depicted in FIG. 5 is applied to the first piezoelectric element 325*a*, and a signal with the second inspection waveform P22 depicted in FIG. 5 is applied to the second piezoelectric element 325*b*. Since the high potential VH is applied to the first piezoelectric element 325*a* due to the first inspection waveform P12, the first piezoelectric element 325*a* and the portion that is included in the vibration plate 324 and is in contact with the first piezoelectric element 325*a* are deformed toward the −z axis side. Since the low potential VL is applied to the second piezoelectric element 325*b* due to the second inspection waveform P22 depicted in FIG. 5 simultaneously with the application of the high potential VH to the first piezoelectric element 325*a*, the second piezoelectric element 325*b* and the portion that is included in the vibration plate 324 and is in contact with the second piezoelectric element 325*b* are deformed toward the +z axis side. Thus, as depicted in FIG. 7, the ink within the first pressure chamber 331 flows toward the communication path 333 as indicated by an arrow A31 and the ink within the second pressure chamber 332 flows toward the side opposite to the communication path 333 as indicated by an arrow A32. Accordingly, the ink within the communication path 333 easily flows in a direction indicated by an arrow A30 or in a direction different from the direction toward the nozzle 320. As a result, the ink may easily flow from the first pressure chamber 331 to the second pressure chamber 332 without being ejected from the nozzle 320.

Residual vibration occurs in the flow path section 33 in the analysis time period ts due to the deformation of the first and second piezoelectric elements 325*a* and 325*b* in the first formation time period ta. In the analysis time period ts, the detecting circuit 302 detects the detection potential signal Vout generated by the first piezoelectric element 325*a* due to the residual vibration of the flow path section 33. The detecting circuit 302 outputs the residual vibration signal Vd based on the detection potential signal Vout to the inspector 16. Then, the inspector 16 inspects the ejection based on the residual vibration signal Vd.

As described above, the printer 1 includes the nozzles 320, the flow path sections 33, the first piezoelectric elements 325*a*, the second piezoelectric elements 325*b*, the first signal generator 151, the second signal generator 152, and the inspector 16. The nozzles 320 eject liquids such as ink. The flow path section 33 includes the first pressure chamber 331, the communication path 333 enabling the nozzle 320 to communicate with the first pressure chamber 331, and the second pressure chamber 332 communicating with the first pressure chamber 331 through the communication path 333. The first piezoelectric element 325*a* changes pressure within the first pressure chamber 331 and the second piezoelectric element 325*b* changes pressure within the second pressure chamber 332. The first signal generator 151 generates the first driving signal ComA to drive the first piezoelectric element 325*a*. The second signal generator 152 generates the second driving signal ComB to drive the second piezoelectric element 325*b*. The inspector 16 inspects the ejection from the nozzle 320 based on the detection potential signal Vout serving as "electromotive force" and generated by the first piezoelectric element 325*a* due to the residual vibration that occurred in the flow path section 33 due to the driving of the first piezoelectric element 325*a*. The first driving signal ComA includes the first inspection waveform P12. The second driving signal ComB includes the second inspection waveform P22 having the polarity opposite to the first inspection waveform P12 for the second formation time period tb overlapping the first formation time period ta for which the first inspection waveform P12 is formed. The first inspection waveform P12 and the second inspection waveform P22 are used for the ejection inspection.

Since the polarity of the first inspection waveform P12 is opposite to the polarity of the second inspection waveform P22, the direction toward which the first piezoelectric element 325*a* is deformed can be opposite to the direction toward which the second piezoelectric element 325*b* is deformed in the first formation time period ta. Thus, as depicted in FIG. 7, even when the ink within the first pressure chamber 331 flows toward the nozzle 320 as indicated by the arrow A31, the ink within the second pressure chamber 332 flows toward the opposite side to the nozzle 320 as indicated by the arrow A32. Accordingly, as indicated by the arrow A30, the ink flows through the communication path 333 and is hardly ejected from the nozzle 320. Therefore, even when the same high potential VH as that to be applied in the ink ejection is applied to the first piezoelectric element 325*a* in the ejection inspection, the ejection may be inspected based on the detection potential signal Vout generated by the first piezoelectric element 325*a* without the ejection of the ink from the nozzle 320. Therefore, in the printer 1 having the circulation flow paths, the ink ejection inspection can be performed with high accuracy.

The first formation time period ta may not completely match the second formation time period tb as long as the first formation time period ta overlaps the second formation time period tb. In other words, it is sufficient if a time period included in the first formation time period ta overlaps a time period included in the second formation time period tb. The timing of the rising of the first inspection waveform P12 may be different from the timing of the falling of the second inspection waveform P22. The timing of the falling of the first inspection waveform P12 may be different from the timing of the rising of the second inspection waveform P22. The "polarities" that are opposite to each other indicate that one of the waveforms has a higher potential than the standard potential VM and the other of the waveforms has a lower potential than the standard potential VM.

2. Second Embodiment

Figure 8:
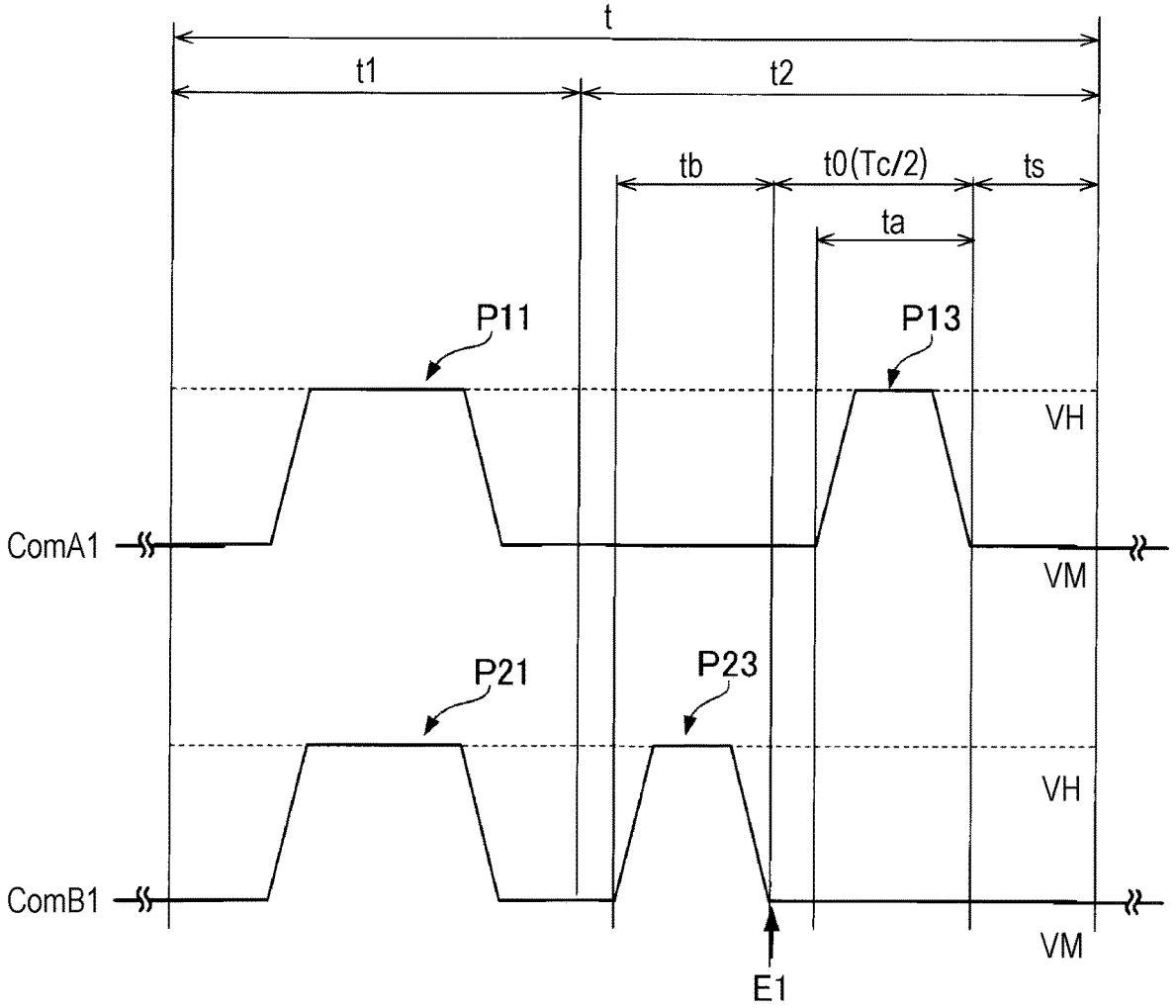
FIG. 8 is a diagram depicting driving waveforms of first and second driving signals according to a second embodiment.
Figure 9:
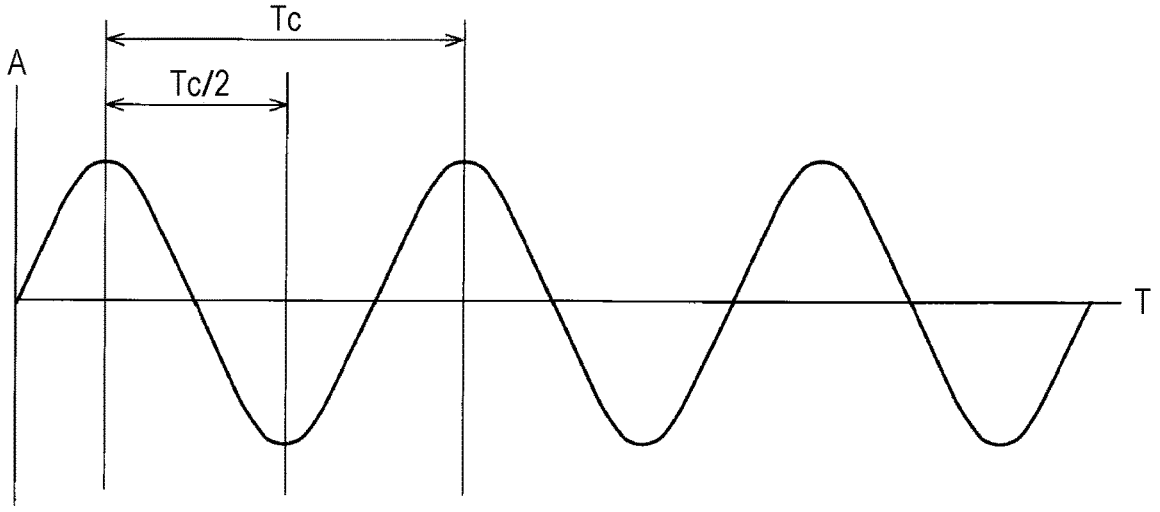
FIG. 9 is a diagram depicting a specific cycle of a second piezoelectric element according to the second embodiment.

FIG. 8 is a diagram depicting driving waveforms of first and second driving signals ComA1 and ComB1 according to a second embodiment. FIG. 9 is a diagram depicting a specific cycle Tc of a second piezoelectric element 325*b* according to the second embodiment. The second embodiment is different from the first embodiment in that the driving waveforms of the first and second driving signals ComA1 and ComB1 are different from the driving waveforms of the first and second driving signals ComA and ComB described in the first embodiment. In the second embodiment, the same items as those described in the first embodiment are indicated by the same symbols as those described in the first embodiment, and a detailed description thereof is omitted.

As depicted in FIG. 8, the second driving signal ComB1 includes a second inspection waveform P23. The second inspection waveform P23 is a positive waveform with a potential higher than the standard potential VM. The second inspection waveform P23 rises from the standard potential VM to the high potential VH. Then, the second inspection waveform P23 is maintained at the high potential VH for a predetermined time period and falls from the high potential VH to the standard potential VM. The second inspection waveform P23 has the same polarity as the first inspection waveform P13. The "same polarity" indicates that the waveforms are at a higher potential than the standard potential VM or are at a lower potential than the standard potential VM.

The driving waveform of the first driving signal ComA1 includes a first ejection waveform P11 and a first inspection waveform P13. The first inspection waveform P13 is formed within a specific time period t0. The specific time period t0 is from an end E1 of a second formation time period tb for which the second inspection waveform P23 is formed. The length of the specific time period t0 is equal to ½ of the specific cycle Tc of the second piezoelectric element 325*b*. FIG. 9 depicts the specific cycle Tc. In FIG. 9, the abscissa indicates time T and the ordinate indicates amplitude A. In the second embodiment, the first and second piezoelectric elements 325*a* and 325*b* have the same configuration. Thus, it can be said that the specific cycle Tc is a specific cycle Tc of the first piezoelectric element 325*a*.

In the second formation time period tb, the second piezoelectric element 325*b* is deformed toward the communication path 333. After the second formation time period tb, the second piezoelectric element 325*b* vibrates due to resilience from the state in which the second piezoelectric element 325*b* is deformed toward the communication path 333. Specifically, after the end E1 of the second formation time period tb, the second piezoelectric element 325*b* is deformed toward the opposite side to the communication path 333 from the state in which the second piezoelectric elements 325*b* is deformed toward the communication path 333. After that, the second piezoelectric element 325*b* is deformed again toward the communication path 333 from the state in which the second piezoelectric element 325*b* is deformed toward the opposite side to the communication path 333. The second piezoelectric element 325*b* is repeatedly deformed toward the communication path 333 and toward the opposite side to the communication path 333 while the deformation of the second piezoelectric element 325*b* decreases. Then, the second piezoelectric element 325*b* is restored to its initial state.

In the specific time period t0 after the end E1 of the second formation time period tb, the second piezoelectric element 325*b* is deformed toward the opposite side to the communication path 333 from the state in which the second piezoelectric element 325*b* is deformed toward the communication path 333. Thus, in the specific time period t0, the ink flows from the communication path 333 toward the second pressure chamber 332.

As described above, the first driving signal ComA1 includes the first inspection waveform P13 formed within the specific time period t0 and having the same polarity as the second inspection waveform P23. As described above, in the specific time period t0, the second piezoelectric element 325*b* is deformed toward the opposite side to the communication path 333. On the other hand, in the specific time period t0, a signal with the first inspection waveform P13 is applied to the first piezoelectric element 325*a*, and the first piezoelectric element 325*a* is deformed toward the communication path 333. Thus, in the specific time period t0, the direction toward which the second piezoelectric element 325*b* is deformed can be opposite to the direction toward which the first piezoelectric element 325*a* is deformed. Therefore, as depicted in FIG. 7, in the specific time period t0, the ink within the first pressure chamber 331 flows toward the communication path 333 as indicated by the arrow A31 and the ink within the second pressure chamber 332 flows toward the side opposite to the communication path 333 as indicated by the arrow A32 as described in the first embodiment. Accordingly, in the second embodiment, the ink ejection may be inspected with high accuracy without the ejection of the ink from the nozzle 320.

It can be said that the end E1 of the second formation time period tb is the time when a meniscus of the nozzle 320 starts to be retracted toward the communication path 333. The displacement of the meniscus of the nozzle 320 follows the deformation of the second piezoelectric element 325*b*. Thus, in the specific time period t0, the meniscus of the nozzle 320 is displaced and retracted toward the +z axis side from a state in which the meniscus of the nozzle 320 protrudes toward the −z axis side. Therefore, it can be said that the end E1 of the second formation time period tb is the time when the meniscus of the nozzle 320 starts to be retracted toward the communication path 333.

3. Third Embodiment

Figure 10:
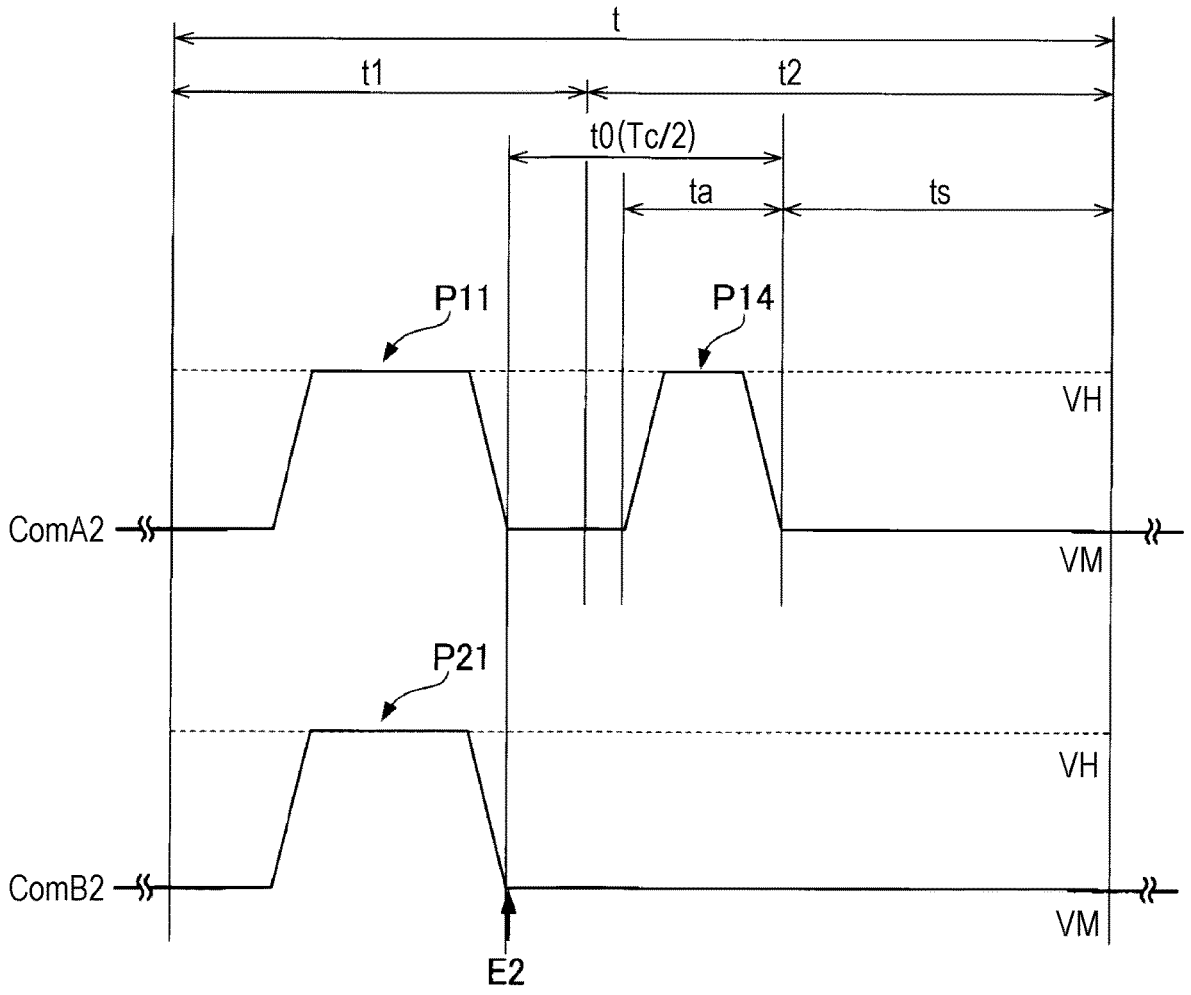
FIG. 10 is a diagram depicting driving waveforms of first and second driving signals according to a third embodiment.

FIG. 10 is a diagram depicting driving waveforms of first and second driving signals ComA2 and ComB2 according to a third embodiment. The third embodiment is different from the second embodiment in that the driving waveforms of the first and second driving signals ComA2 and ComB2 are different from the driving waveforms of the first and second driving signals ComA1 and ComB1 described in the second embodiment. In the third embodiment, the same items as those described in the second embodiment are indicated by the same symbols as those described in the second embodiment, and a detailed description thereof is omitted.

As depicted in FIG. 10, the driving waveform of the second driving signal ComB2 includes a second ejection waveform P21 and does not include the second inspection waveform P23 described in the second embodiment.

The driving waveform of the first driving signal ComA2 includes a first ejection waveform P11 and a first inspection waveform P14. The first inspection waveform P14 is formed within a specific time period t0. The specific time period t0 is from an end E2 of a second formation time period tb for the second ejection waveform P21 is formed. The length of the specific time period t0 is equal to ½ of the specific cycle Tc of the piezoelectric element 325*b*.

In the third embodiment, the second ejection waveform P21 has a function as a "second inspection waveform". In other words, the "second inspection waveform" is the second ejection waveform P21 as an "ejection waveform" for ejecting a liquid such as ink from the nozzle 320. In the third embodiment, in the specific time period to, a signal with the first inspection waveform P14 is applied, and thus the direction toward which the second piezoelectric element 325*b* is deformed can be opposite to the direction toward which the first piezoelectric element 325*a* is deformed, similarly to the second embodiment. In the third embodiment, as depicted in FIG. 7, in the specific time period t0, the ink within the first pressure chamber 331 flows toward the communication path 333 as indicated by the arrow A31, and the ink within the second pressure chamber 332 flows toward the opposite side to the communication path 333 as indicated by the arrow A32, similarly to the second embodiment. Accordingly, the ink ejection may be inspected with high accuracy without the ejection of the ink from the nozzle 320.

4. Modified Examples

The embodiments exemplified above may be modified. Specific modified examples that are applicable to the embodiments are exemplified below. Two or more modified examples selected from among the following modified examples may be combined without contradicting each other.

4-1. First Modified Example

The first inspection waveform P13 and the second inspection waveform P23 that are described in the second embodiment are in the same shape. However, the amplitude, frequency, or the like of the first inspection waveform P13 may be different from the amplitude, frequency, or the like of the second inspection waveform P23.

Figure 11:
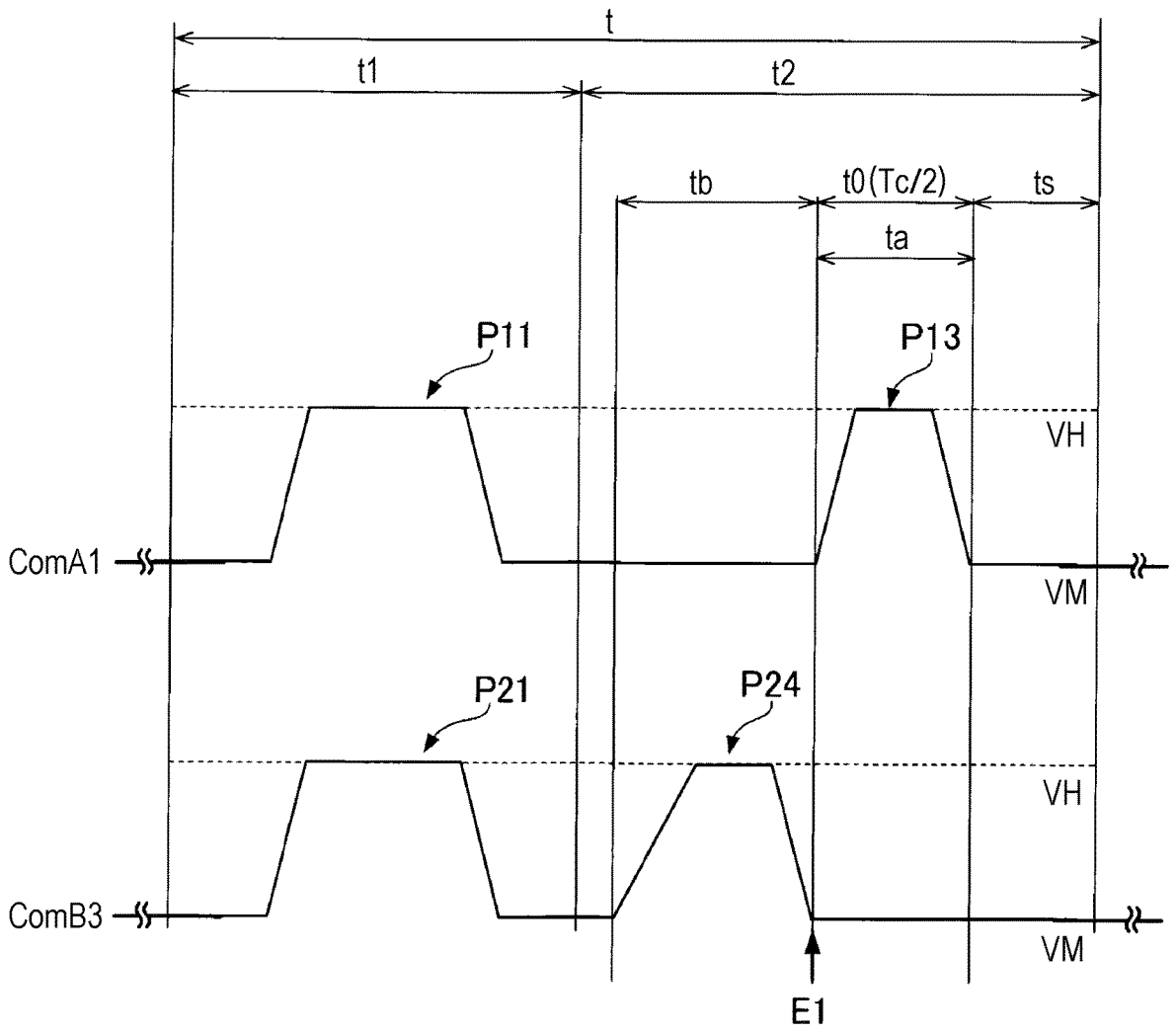
FIG. 11 is a diagram depicting driving waveforms of first and second driving signals according to a first modified example.

FIG. 11 is a diagram depicting driving waveforms of first and second driving signals ComA1 and ComB3 according to a first modified example. As depicted in FIG. 11, the second driving signal ComB3 includes a second inspection waveform P24. The second inspection waveform P24 is a positive waveform. A rate at which the second inspection waveform P24 rises is lower than a rate at which the second inspection waveform P24 falls. It is, therefore, possible to prevent the ejection of ink in the second time period t2 more efficiently than the second inspection waveform P22 described in the second embodiment. The rate at which the second inspection waveform P24 falls is higher than the rate at which the second inspection waveform P24 rises. Thus, an amount by which the second piezoelectric element 325*b* is deformed in the specific time period t0 can be larger than that when the rate at which the second inspection waveform P24 falls is lower than the rate at which the second inspection waveform P24 rises. Therefore, even when, for example, a higher potential than the high potential VH is applied to the first piezoelectric element 325*a*, it is possible to efficiently prevent the ejection of the ink in the second time period t2.

4-2. Second Modified Example

Figure 12:
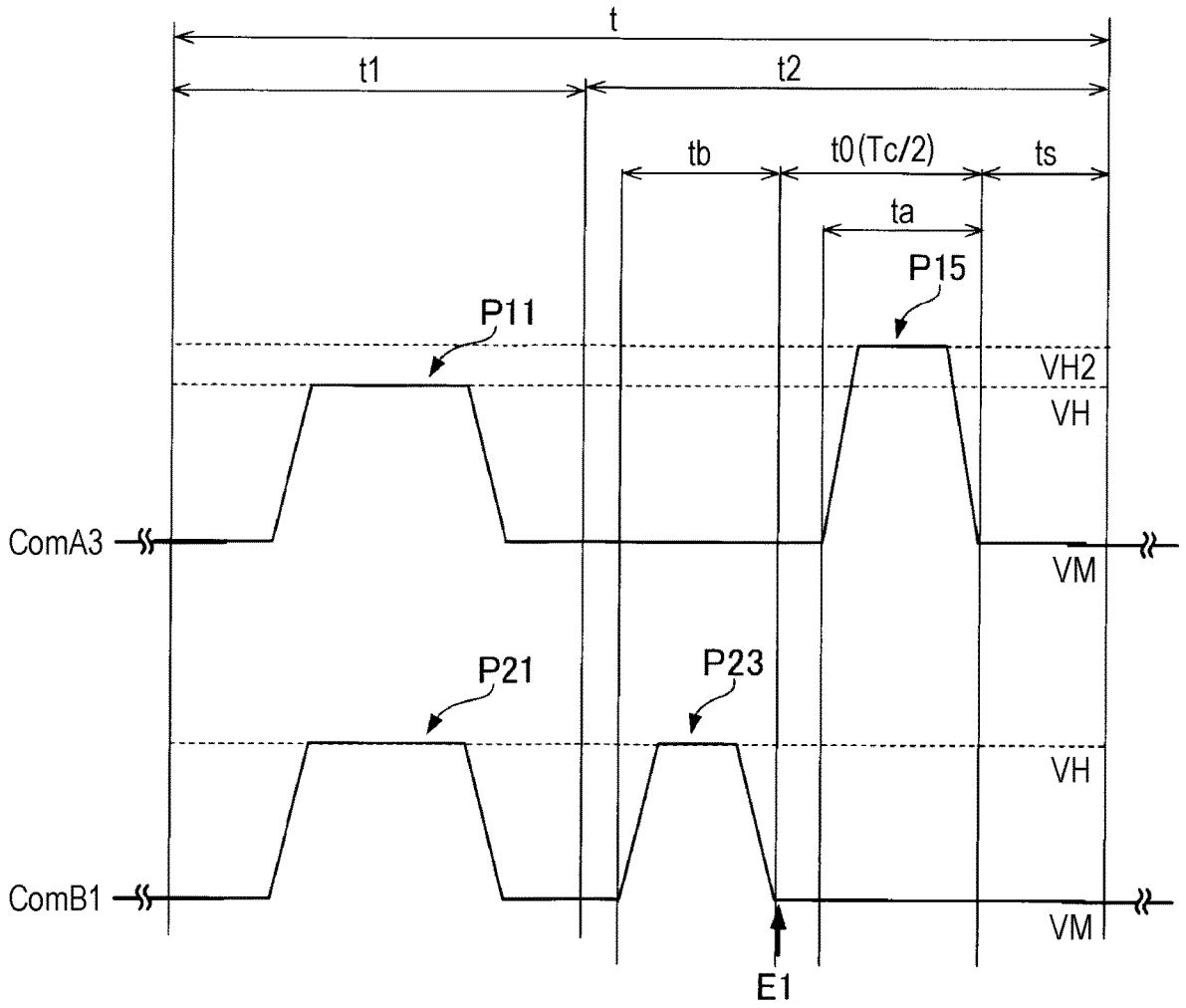
FIG. 12 is diagram depicting driving waveforms of first and second driving signals according to a second modified example.

FIG. 12 is a diagram depicting driving waveforms of first driving signals ComA3 and ComB1 according to a second modified example. As depicted in FIG. 12, a first inspection waveform P15 of the first driving signal ComA3 includes a time period at which the first inspection waveform P15 is at a second high potential VH2 higher than the high potential VH. Thus, the amplitude of the first inspection waveform P15 is larger than the amplitude of the second inspection waveform P23. As described above, in the specific time period t0, ink flows toward the second pressure chamber 332 due to the second inspection waveform P23. Thus, even when the amplitude of the first inspection waveform P15 is larger than the amplitude of the second inspection waveform P23, the probability that the ink is ejected from the nozzle 320 in the specific time period t0 can be reduced. Therefore, the ejection can be inspected based on a detection potential signal Vout generated based on the first inspection waveform P15 having the amplitude larger than the amplitude of the first ejection waveform P11. Accordingly, the ink ejection can be inspected with high accuracy. In addition, since the amplitude of the second inspection waveform P23 is smaller than the amplitude of the first inspection waveform P15, the ejection of the ink can be suppressed by the driving, caused by the second inspection waveform P23, of the second piezoelectric element 325*b*. Especially, even when the nozzle 320 overlaps the second pressure chamber 332 when viewed from the +z direction, the ejection of the ink can be suppressed.

4-3. Third Modified Example

Figure 13:
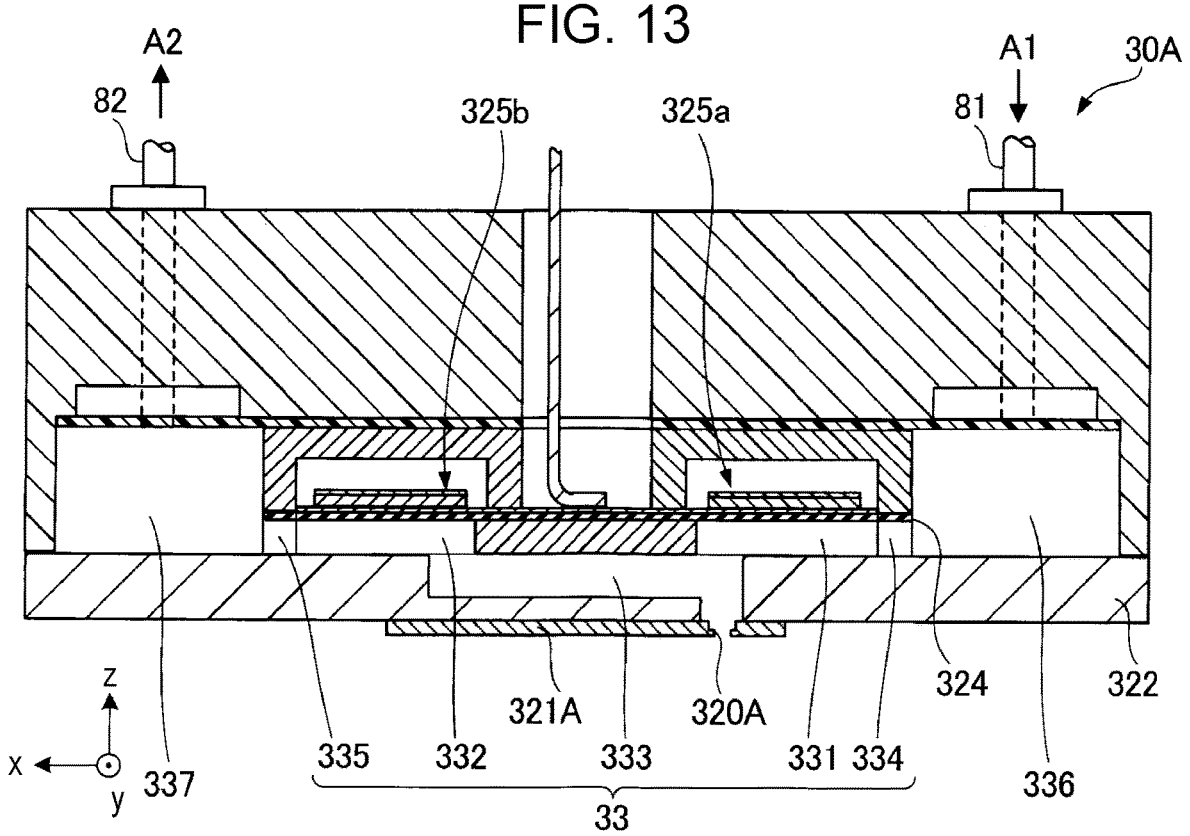
FIG. 13 is a sectional view depicting a configuration of a head unit according to a third modified example.

FIG. 13 is a sectional view depicting a configuration of a head unit 30A according to a third modified example. A nozzle 320A formed in a nozzle plate 321A included in the head unit 30A overlaps a first pressure chamber 331 when viewed from the +z direction in which a first piezoelectric element 325*a* and the first pressure chamber 331 are arranged side by side. Thus, a distance between the nozzle 320A and the first pressure chamber 331 is shorter than that in the case the nozzle 320A overlaps a second pressure chamber 332 when viewed from the +z direction. Therefore, the ejection of ink from the nozzle 320A can be inspected with high accuracy.

4-4. Fourth Modified Example

Figure 14:
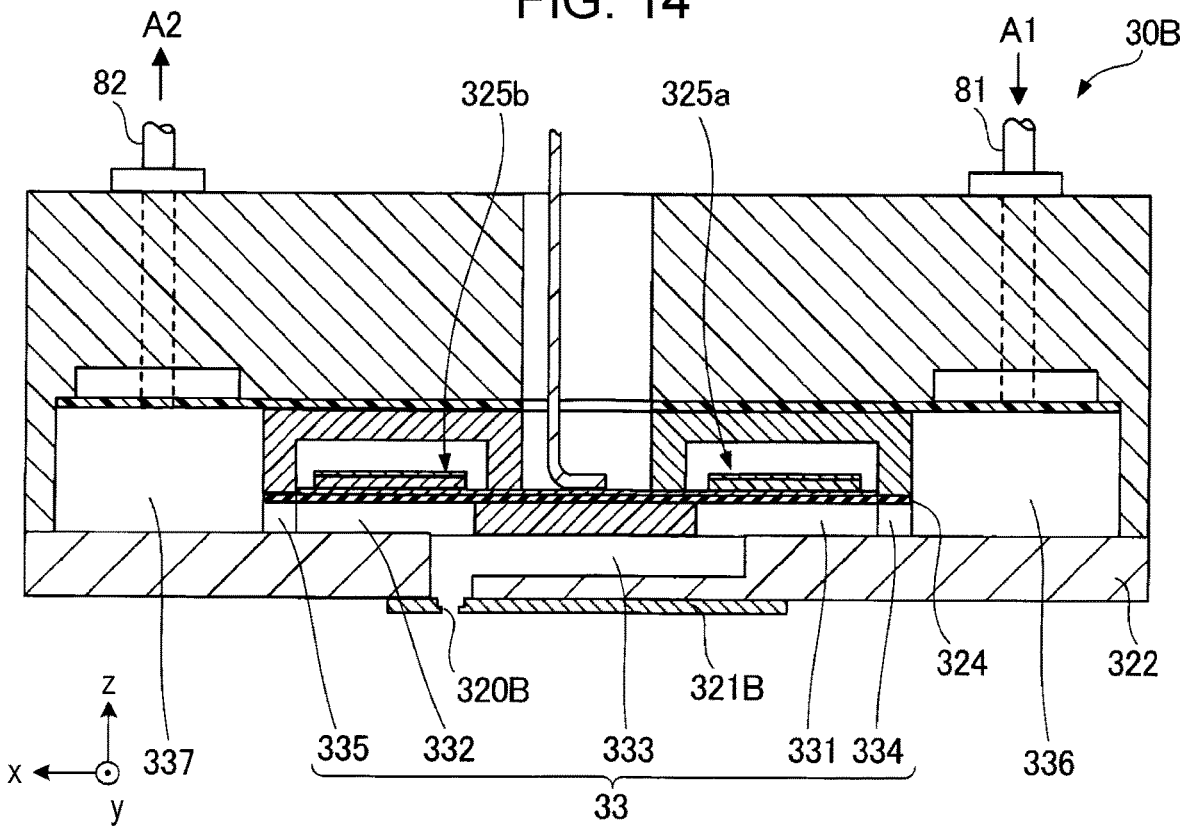
FIG. 14 is a sectional view depicting a configuration of a head unit according to a fourth modified example.

FIG. 14 is a sectional view depicting a configuration of a head unit 30B according to a fourth modified example. As depicted in FIG. 14, a nozzle 320B formed in a nozzle plate 321B included in the head unit 30B overlaps a second pressure chamber 332 when viewed from the +z direction in which a second piezoelectric element 325*b* and the second pressure chamber 332 are arranged side by side. Thus, the ejection of ink can be suppressed by the driving of a first piezoelectric element 325*a* in the ejection inspection, compared with the case where the nozzle 320B overlaps a first pressure chamber 331 when viewed from the +z direction. Therefore, even when a higher potential than the high potential VH is applied to the first piezoelectric element 325*a*, it is possible to efficiently prevent the ejection of the ink in the second time period t2. In the fourth modified example, it is preferable that a detection potential signal Vout generated by the second piezoelectric element 325*b* due to residual vibration of a flow path section 33 be detected. Thus, the ejection of the ink from the nozzle 320B can be inspected with high accuracy.

In addition, the ejection may be inspected based on a detection potential signal Vout generated by the first piezoelectric element 325*a* and a detection potential signal Vout generated by the second piezoelectric element 325*b*.

4-5. Fifth Modified Example

The first inspection waveform P12 and the second inspection waveform P22 that are described in the first embodiment have polarities different from each other, while the amplitude and the like of the first inspection waveform P12 are the same as those of the second inspection waveform P22. The shape and the like of the first inspection waveform P12, however, may be different from those of the second inspection waveform P22.

4-6. Sixth Modified Example

In each of the embodiments, the first ejection waveform P11 and the second ejection waveform P21 are in the same shape, but the amplitude, frequency, or the like of the first ejection waveform P11 may be different from that of the second ejection waveform P21. The amount of ink to be ejected from the nozzle 320 can be changed by changing one or more of rising rates, falling rates, the maximum potential values, the minimum potential values, the amplitude, and the frequencies of the first and second ejection waveforms P11 and P21. In addition, the size of an ink dot to be formed on the medium M can be changed by changing the number of first ejection waveforms P11 in each of the cycles t or the number of second ejection waveforms P12 in each of the cycles t.

4-7. Seventh Modified Example

In each of the embodiments, the ink can be ejected by driving the first and second piezoelectric elements 325*a* and 325*b*. The printer 1 may be configured so that the ink can be ejected by driving either the first piezoelectric elements 325*a* or the second piezoelectric elements 325*b*. In a seventh modified example, the detection potential signal Vout may be detected by a piezoelectric element that is not driven. Thus, the detection potential signal Vout generated due to the residual vibration of the flow path section 33 can be detected even when printing is executed at a high speed or even when a time interval between ejection signals is short and the residual vibration cannot be detected by a single piezoelectric element.

4-8. Eighth Modified Example

The driving signal generator 15 may generate a driving signal other than the first driving signal ComA and the second driving signal ComB. It is sufficient if the first driving signal ComA includes at least a "first inspection waveform" and the second driving signal ComB includes at least a "second inspection waveform". Thus, the driving signal generator 15 may generate a driving signal including a waveform for ejection of ink separately from the first driving signal ComA and the second driving signal ComB. Each of the first and second driving signals ComA and ComB may further include another waveform such as a waveform for circulation. The same applies to the first driving signals ComA1, ComA2, and ComA3 and the second driving signals ComB1, ComB2, and ComB3.

4-9. Ninth Modified Example

Each of the head units 30 can circulate ink, but may not circulate ink. The configurations of the first piezoelectric elements 325*a* may be different from the configurations of the second piezoelectric elements 325*b* as long as the first and second piezoelectric elements 325*a* and 325*b* do not significantly impede the highly accurate inspection of the ink ejection. The same applies to the first and second pressure chambers 331 and 332.

The disclosure is described based on the embodiments with reference to the drawings, but is not limited to this. The configurations of the components described in the disclosure may be replaced with arbitrary configurations having the same functions as described in the embodiments. In addition, arbitrary configurations may be added to the configurations of the components described in the embodiments. Furthermore, in the disclosure, arbitrary two or more of the configurations described in the embodiments may be combined.

What is claimed is:

1. A liquid droplet ejecting apparatus comprising:

a nozzle that ejects a liquid;

a flow path section having a first pressure chamber, a communication path enabling the nozzle to communicate with the first pressure chamber, and a second pressure chamber communicating with the first pressure chamber through the communication path;

a first piezoelectric element that changes pressure within the first pressure chamber;

a second piezoelectric element that changes pressure within the second pressure chamber;

a first signal generator that generates a first driving signal to drive the first piezoelectric element;

a second signal generator that generates a second driving signal to drive the second piezoelectric element; and an inspector that inspects the ejection from the nozzle based on electromotive force generated by the first or second piezoelectric element due to residual vibration that has occurred in the flow path section due to the driving of the first piezoelectric element, wherein the first driving signal includes a first inspection waveform, and the second driving signal includes a second inspection waveform having a polarity opposite to the first inspection waveform for a time period overlapping a first formation time period for the first inspection waveform.

2. The liquid droplet ejecting apparatus according to claim 1, wherein an amplitude of the first inspection waveform is larger than an amplitude of the second inspection waveform.

3. The liquid droplet ejecting apparatus according to claim 1, wherein the nozzle overlaps the first pressure chamber when the nozzle is viewed from a direction in which the first piezoelectric element and the first pressure chamber are arranged side by side.

4. The liquid droplet ejecting apparatus according to claim 1, wherein the nozzle overlaps the second pressure chamber when the nozzle is viewed from a direction in which the second piezoelectric element and the second pressure chamber are arranged side by side.

5. A liquid droplet ejecting apparatus comprising:

a nozzle that ejects a liquid;

a flow path section having a first pressure chamber, a communication path enabling the nozzle to communicate with the first pressure chamber, and a second pressure chamber communicating with the first pressure chamber through the communication path;

a first piezoelectric element that changes pressure within the first pressure chamber;

a second piezoelectric element that changes pressure within the second pressure chamber;

a first signal generator that generates a first driving signal to drive the first piezoelectric element;

a second signal generator that generates a second driving signal to drive the second piezoelectric element; and an inspector that inspects the ejection from the nozzle based on electromotive force generated by the first or second piezoelectric element due to residual vibration that has occurred in the flow path section due to the driving of the first piezoelectric element, wherein the second driving signal includes a second inspection waveform, and the first driving signal includes a first inspection waveform having a polarity identical with the second inspection waveform in a time period of ½ of a specific cycle of the second piezoelectric element, the time period being from an end of a second formation time period for the second inspection waveform.

6. The liquid droplet ejecting apparatus according to claim 5, wherein the second inspection waveform is an ejection waveform for causing the liquid to be ejected from the nozzle.

7. The liquid droplet ejecting apparatus according to claim 5, wherein a rate at which the second inspection waveform rises is lower than a rate at which the second inspection waveform falls.

* * * * *